United States Patent [19]

Lopez de Cardenas

[11] Patent Number: 5,063,822

[45] Date of Patent: Nov. 12, 1991

[54] PERFORATING GUN ASSEMBLY INCLUDING A CARRIER HAVING A FIRST SECTION ADAPTED TO SEPARATE FROM A SECOND SECTION WHEN A CHARGE ON THE SECOND SECTION DETONATES

[75] Inventor: Jorge E. Lopez de Cardenas, Houston, Tex.

[73] Assignee: Schlumberger Technology Corporation, Houston, Tex.

[21] Appl. No.: 565,383

[22] Filed: Aug. 9, 1990

[51] Int. Cl.[5] ..... E21B 43/117; F42B 1/02

[52] U.S. Cl. ..... 89/1.15; 166/55.1; 175/4.6

[58] Field of Search ..... 89/1.15; 175/4.6; 166/63, 55, 297

[56] References Cited

U.S. PATENT DOCUMENTS

| | | | |
|---|---|---|---|
| 3,048,101 | 8/1962 | Lebourg | 175/4.6 |
| 4,253,523 | 3/1981 | Ibsen | 175/4.6 |
| 4,467,878 | 8/1984 | Ibsen | 175/4.6 |
| 4,496,009 | 1/1955 | DerMott et al. | 175/4.6 |
| 4,765,409 | 8/1988 | McClure et al. | 166/55.1 |
| 4,771,827 | 9/1988 | Barker et al. | 166/55.1 |

FOREIGN PATENT DOCUMENTS

| | | | |
|---|---|---|---|
| 2539947 | 4/1976 | Fed. Rep. of Germany | 175/4.6 |

*Primary Examiner*—David H. Brown

*Attorney, Agent, or Firm*—Henry N. Garrana; John H. Bouchard

[57] ABSTRACT

A novel dropoff apparatus adapted for use in a perforating gun or other such apparatus adapted to be disposed in a borehole includes an embrittled carrier section connected to a further section of the perforating gun or other such apparatus. The embrittled carrier section includes an embrittled carrier and a explosive charge, such as a capsule charge, mounted on the embrittled carrier. When the charge detonates, since the carrier section is embrittled, the carrier section is severed from further section of the perforating gun, or other apparatus, and the further section falls to a bottom of the borehole. The carrier section may undergo geometrical embrittlement by disposing a notch through at least one side of the carrier section; when the charge detonates, the carrier section is severed from the further section of the gun, or other apparatus, along a line connected to the notch, the further section of the gun, or other apparatus, falling to a bottom of the borehole. The carrier section may also undergo material embrittlement by either heating or heat treating the carrier section to the austenite region, and then quenching the carrier section; when the charge detonates, the carrier section shatters thereby separating the further section of the gun, or other apparatus, from the remainder of the perforating gun, the further section of the gun, or other apparatus, falling to a bottom of the borehole.

8 Claims, 1 Drawing Sheet

FIG. 1
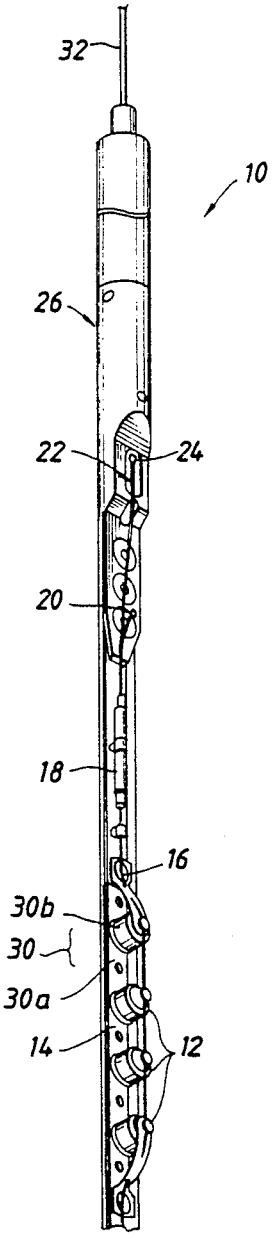
FIG. 2
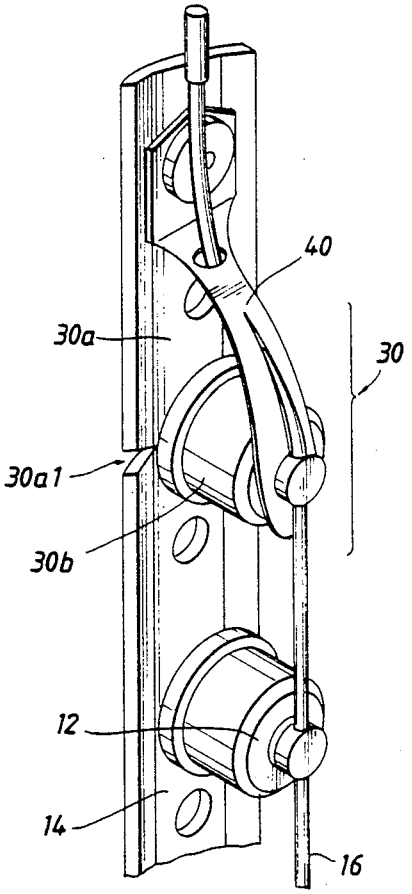
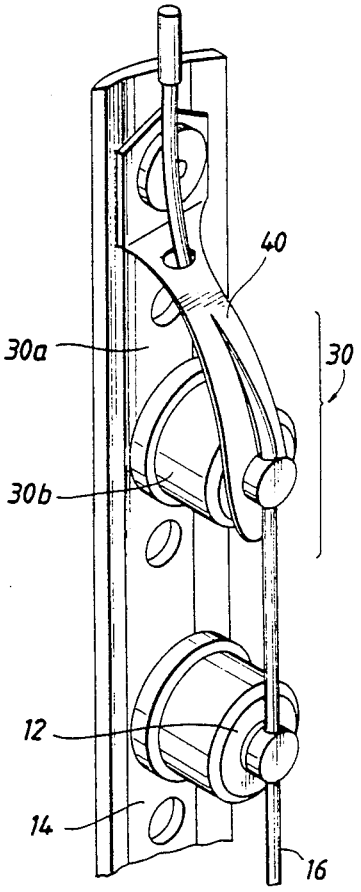
FIG. 3

PERFORATING GUN ASSEMBLY INCLUDING A CARRIER HAVING A FIRST SECTION ADAPTED TO SEPARATE FROM A SECOND SECTION WHEN A CHARGE ON THE SECOND SECTION DETONATES

BACKGROUND OF THE INVENTION

The subject matter of the present invention relates to a drop off apparatus for a perforating gun capsule charge carrier.

Perforating guns are disposed in oil well boreholes for perforating a formation traversed by the borehole, a well fluid being produced from the perforated formation. The perforating gun includes a carrier and a plurality of capsule charges mounted on the carrier. When the charges detonate, the formation is perforated. The carrier is often deformed as a result of the detonation of the capsule charges. Since the well dimensions are often very small, it is risky if not impossible to retrieve a distorted or deformed carrier strip from the well. In some cases, it is preferable to drop the perforating gun to the bottom of the well after detonating the capsule charges mounted on the carrier. Prior art perforating gun systems include a dropping mechanism which is designed to drop the perforating gun to the bottom of the well. In the prior art system, the dropping mechanism dropped the head of the perforating gun, or part of it, to the bottom of the well along with the charges. This abandonment of the perforating gun head can be very expensive. In addition, special hardware is often needed to operate the dropping mechanism on the prior art systems.

SUMMARY OF THE INVENTION

Accordingly, it is a primary object of the present invention to provide a special dropping apparatus for a perforating gun, the dropping apparatus being designed to drop a selective section of the perforating gun to a bottom of the well by simply detonating a selected capsule charge mounted near or on the dropping apparatus.

It is a further object of the present invention to provide the special dropping apparatus for the perforating gun, the perforating gun including a carrier, the dropping apparatus being a notched section of the carrier, the selected capsule charge detonating near the notched section of the carrier in response to a command from an operator thereby severing the carrier along the notched section.

It is a further object of the present invention to provide the special dropping apparatus for the perforating gun, the dropping apparatus being an embritted section of the carrier, the selected capsule charge detonating near the embrittled section of the carrier in response to a command from an operator thereby shattering the embrittled section and severing the carrier along the embrittled section.

These and other objects of the present invention are accomplished by providing a perforating gun which includes a first carrier strip, a plurality of capsule charges mounted on the carrier strip, and a dropping section connected to the carrier strip, the dropping section including a second carrier strip connected to the first carrier strip and a further capsule charge mounted to the second carrier strip, the second carrier strip being severed from the first carrier strip when the further capsule charge mounted on the second carrier strip detonates. The second carrier strip may include a strip of carrier having at least one notch disposed through at least one end, or it may include an embrittled section of the second carrier. When the further capsule charge detonates, a cut within the second carrier strip appears along a line coincident with the notch; or, the embrittled section of the second carrier strip is shattered thereby severing the second carrier strip from the first carrier strip.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates a perforating gun having a dropoff apparatus;

FIG. 2 illustrates one embodiment of the dropoff apparatus of FIG. 1 in greater detail; and FIG. 3 illustrates another embodiment of the dropoff apparatus of FIG. 1 in greater detail.

DETAILED DESCRIPTION OF THE PREFERRED EMBODIMENT

Referring to FIG. 1, a perforating gun having a dropoff apparatus in accordance with the present invention is illustrated.

In FIG. 1, a perforating gun 10 includes a plurality of capsule charges 12 mounted on a carrier strip 14 and a dropoff section 30, in accordance with the present invention, connected to the carrier strip 14 on one end of the plurality of capsule charges 12 and forming an integral part of the carrier strip 14. The dropoff section 30 includes a further section of carrier strip **30*a* integrally connected to the carrier strip 14 and a further capsule charge 30*b* mounted to the further section of carrier strip 30*a*. The further section of carrier strip 30*a* is actually an "embrittled" or "weakened" version of the carrier strip 14, that is, a portion of the carrier strip 14 corresponding to the dropoff section 30 is made brittle or it is otherwise "weakened" from the standpoint of impact loading and not necessarily from the standpoint of strength. For example, a portion of the carrier strip 14 undergoes either a geometrical or a material embrittlement process to produce the further section of carrier strip 30*a*, the embrittlement processes being described in more detail below. A detonating cord 16 is connected to each of the plurality of capsule charges 12 and the further capsule charge 30*b*. The remaining portion of the perforating gun 10 of FIG. 1 is not important for purposes of the present invention, but nevertheless includes a detonator 18, a ground connection 20, a female connector 22, a fluid to air connector 24, and an adapter head 26. A wireline or other such apparatus 32 is connected to an end of the perforating gun 10, the gun 10** being suspended by the wireline or other apparatus in a borehole adjacent a formation to be perforated.

The carrier strip 14 (including the further section of carrier strip 30*a* before embrittlement) is a steel strip made of carbon steel 1038 with a hardness of about 20–24 Rockwell scale c. The first two digits "10" of the number "1038" indicate that the carrier strip 14 is plain carbon steel, containing no alloys, such as nickel, chromium and/or molybdenum. The last two digits "38" indicate the carbon content of the steel in hundredths of a percent, i.e., 0.38% carbon.

In operation, referring to FIG. 1, the perforating gun 10 is suspended in the borehole by the apparatus 32, such as a wireline. A detonation wave begins to propagate through the detonating cord 16 and first detonates the further capsule charge 30*b*. The detonation wave then detonates the capsule charges 12. However, all capsule charges 30*b* and 12 are detonated substantially simultaneously. Detonation of the further capsule charge 30*b* produces stress and/or strain within the further section of carrier strip 30*a*, enough to cause the further section of carrier strip 30*a* to break apart. When the further section of carrier strip 30*a* breaks apart, all capsule charges 12, which have already detonated, are separated from the remaining portion of the perforating gun 10 and fall to the bottom of the borehole.

The further section of carrier strip 30*a* of the dropoff section 30 is modified structurally to produce a brittle condition such that, when the further capsule charge 30*b* detonates, the further carrier strip 30*a* breaks apart and separates the plurality of capsule charges 12 from the remainder of the gun 10, the capsule charges 12 and associated carrier strip 14 falling to a bottom of the borehole.

The structural modification of the further section of carrier strip 30*a* to produce a brittle condition may be achieved as follows:

1. Geometrical embrittlement by the introduction of a notch or abrupt change in a section of the further carrier strip 30*a* so as substantially triaxial local stress state (to be further discussed with reference to FIG. 2); and 2. Material embrittlement by thermal, chemical, mechanical or thermomechanical treatment which severely limits the ability of the material to plastically deform in response to loading, especially impact loading (to be discussed with reference to FIG. 3).

In ferrous materials, the material embrittlement treatments include, but are not limited to:

2*a*. localized plastic deformation which exhausts the capacity of the material for substantial further plastic deformation;

2*b*. cooling from a temperature in the austenite phase field at a rate sufficient to transform the microstructure to martensite, without subsequent tempering, or with subsequent tempering at a temperature which produces "blue brittleness", temper embrittlement, or tempered martensite embrittlement;

2*c*. localized chilling to below the ductile-brittle transition temperature of the material by, for instance, the application of liquid nitrogen;

2*d*. localized carburizing, nitriding, or other surface treatment which produces high hardness and limited capacity for plastic deformation;

2*e*. localized application of an embrittling species such as cadmium, lead, or copper, either on the surface or as a deliberate alloying addition (localized alloying to produce a brittle intermetallic compound or ordering reaction); or

2*f*. localized neutron irradiation to produce degraded ductility.

In non-ferrous metals, the material embrittlement treatments include, but are not limited to:

2*g*. localized plastic deformation which exhausts the capacity of the material for substantial further plastic deformation;

2*h*. localized neutron irradiation to degrade ductility;

2*i*. localized application of an embrittling species, or local alloying to produce a brittle intermetallic compound or ordering reaction; or

2*j*. precipitation hardening or other heat treatment which increases the strength and limits the capacity for plastic deformation.

Any combination of the above processes may be utiliized to embrittle the further section of carrier strip 30*a* of the dropoff section 30.

Referring to FIG. 2, one embodiment of the drop off section 30 of FIG. 1 is illustrated.

In FIG. 2, the drop off section 30 includes the further section of carrier strip 30*a* and the further capsule charge 30*b* mounted thereon. The further section of carrier strip 30*a* is shown integrally connected to the carrier strip 14. The further capsule charge 30*b* is mounted on the further section of carrier strip 30*a*, and one of the plurality of capsule charges 12 is shown mounted on the carrier strip 14. The detonating cord 16 is connected to each charge. A cord protector 40 protects the detonating cord 16.

In accordance with one embodiment of the present invention, the further section of carrier strip 30*a* has been weakened, that is, the further carrier strip 30*a* has been geometrically embrittled. The further section of carrier strip 30*a* has been geometrically embrittled by placing a first notch 30*a*1 on one side of the further section of carrier strip 30*a*. A further second notch (not shown in the drawings) could also be placed opposite the first notch on the other side of the further section of carrier strip 30*a*. The presence of the notch(s) 30*a*1 on the side(s) of the further section of carrier 30*a* weakens the further carrier section 30*a*. When the further capsule charge 30*b* detonates, the energy produced from the detonation of the further capsule charge 30*b* applies a very high stress on the further section of carrier 30*a* adjacent the notch 30*a*1 (or between the notchs) thereby breaking the further carrier section 30*a* adjacent to (or between) the notch(s). When this happens, the section of the perforating gun 10 which includes the capsule charges 12 drops off the perforating gun and falls to the bottom of the borehole.

It is obvious to one skilled in the art that, in lieu of the notch(s), holes or grooves could be disposed in or through the further section of carrier 30*a*. The disposition of the holes or grooves through the further carrier section 30*a* would have the same effect of weakening or geometrically embrittling the further carrier section 30*a*.

Referring to FIG. 3, another embodiment of the drop off section 30 of FIG. 1 is illustrated.

In FIG. 3, the drop off section 30 includes the further section of carrier strip 30*a* and the further capsule charge 30*b* mounted thereon. The further section of carrier strip 30*a* is again shown integrally connected to the carrier strip 14. The further capsule charge 30*b* is mounted on the further section of carrier strip 30*a*, and one of the plurality of capsule charges 12 is mounted on the carrier strip 14. The detonating cord 16 is connected to each charge. A cord protector 40 protects the detonating cord 16. In accordance with another embodiment of the present invention, the further section of carrier strip 30*a* has been weakened, that is, the further carrier strip 30*a* has been materially embrittled. The further section of carrier strip 30*a* is materially embrittled by processing the further carrier section in accordance with the following treatment process:

1. heat the further carrier section 30*a* (e.g., induction heating) to the austenite region (normally above 1500 to 1600 degrees F.);

2. quench the austenite further carrier section 30*a* in water (or brine solution) thereby transforming its microstructure to martensite (for a 1038 steel, typical hardness is above 45 Rockwell scale c)

When the further carrier section 30*a* is materially embrittled in the above manner, it will easily break apart when the further capsule charge 30*b* detonates. In addition, however, the materially embrittled further carrier section 30*a* may also be geometrically embrittled in the manner described above (i.e., placement of at least one notch adjacent an edge of the further carrier section 30*a*).

The presence of the material embrittlement in the structure of the further section of carrier 30*a* weakens the further carrier section 30*a*. When the further capsule charge 30*b* mounted thereon detonates, the energy produced from the detonation of the further capsule charge 30*b* applies a very high stress within the materially embrittled further carrier section 30*a* thereby breaking (or shattering) the materially embrittled further carrier section 30*a*. When this happens, the section of the perforating gun 10 which includes the capsule charges 12 drops off the perforating gun and falls to the bottom of the borehole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating gun assembly adapted to be disposed in a borehole, comprising:

a carrier, said carrier including a first section and a second section connected to said first section, said second section including a heat treated material having a hardness of above 45 rockwell scale c;

at least one charge mounted on said first section of said carrier;

at least one additional charge mounted on said second section of said carrier, said at least one additional charge adapted to detonate, said second section of said carrier shattering when said at least one additional charge detonates, said first section of said carrier separating from said second section when said second section shatters thereby allowing said first section of said carrier to drop to a bottom of said borehole.

2. The perforating gun assembly of claim 1, wherein said first section of said carrier is integrally connected to said second section, the first and second sections forming a single piece.

3. A perforating gun assembly adapted to be disposed in a borehole, comprising:

a carrier, said carrier including a first section and a second section connected to said first section, said second section including a geometrically weakened portion;

at least one charge mounted on said first section of said carrier;

at least one additional charge mounted on said second section of said carrier, said at least one additional charge adapted to detonate, said first section of said carrier separating from said second section along a line including said geometrically weakened portion when said at least one additional charge on said second section detonates thereby allowing said first section of said carrier to drop to a bottom of said borehole.

4. The perforating gun assembly of claim 3, wherein said geometrically weakened portion of said second section comprises a notch disposed in said second section.

5. The perforating gun assembly of claim 3, wherein said geometrically weakened portion of said second section comprises a hole disposed in said second section.

6. The perforating gun assembly of claim 3, wherein said geometrically weakened portion of said second section comprises a groove disposed in said second section.

7. A perforating gun assembly adapted to be disposed in a borehole, comprising:

a carrier, said carrier including a first section and a second section connected to said first section, said second section including a heat treated material having a microstructure comprised of martensite;

at least one charge mounted on said first section of said carrier;

at least one additional charge mounted on said second section of said carrier, said at least one additional charge adapted to detonate, said second section of said carrier shattering when said at least one additional charge detonates, said first section of said carrier separating from said second section when said second section shatters thereby allowing said first section of said carrier to drop to a bottom of said borehole.

8. The perforating gun assembly of claim 7, wherein the martensite microstructure has a hardness of above 45 rockwell scale c.

* * * * *